United States Patent [19]

Zhurkina et al.

[11] 4,108,648

[45] Aug. 22, 1978

[54] NICKEL-BASED ALLOY

[76] Inventors: Galina Vasilievna Zhurkina; Galina Evseevna Moskalenko, both of 2 Frunzenskaya ulitsa, 10, kv. 81; Fedor Fedorovich Khimushin, B. Dorogomilovskaya ulitsa, 29, kv. 26; Nikolai Fedorovich Lashko, Kosinsky pereulok, 18, korpus 3, kv. 272; Klavdia Pavlovna Sorokina, Kosinsky pereulok, 20, korpus 1, kv. 62, all of Moscow; Tamara Mikhailovna Grebtsova, ulitsa Gorkogo, 15, kv. 5, Elektrostal Moskovskoi oblasti; Evgenia Markovna Kontsevaya, Kotelnicheskaya naberezhnaya, 1/5, korpus A, kv. 15, Moscow, all of U.S.S.R.

[21] Appl. No.: 724,469

[22] Filed: Sep. 20, 1976

[51] Int. Cl.[2] ..... C22C 19/05

[52] U.S. Cl. ..... 75/171; 148/32.5

[58] Field of Search ..... 75/171, 170; 148/32, 148/32.5

[56] References Cited

U.S. PATENT DOCUMENTS 3,865,581 2/1975 Sekino et al. ..... 75/171

*Primary Examiner*—R. Dean

*Attorney, Agent, or Firm*—Lackenbach, Lilling & Siegel

[57] ABSTRACT

A nickel-based alloy containing in weight %:

| | |
|---|---|
| carbon | 0.05 - 0.10 |
| chromium | 15.0 - 18.0 |
| cobalt | 10.0 - 17.0 |
| titanium | 1.8 - 2.5 |
| aluminum | 2.8 - 3.5 |
| tungsten | 2.5 - 5.0 |
| molybdenum | 6.0 - 7.5 |
| yttrium | up to 0.2 |
| boron | 0.005 - 0.02 |
| magnesium | 0.005 - 0.05 |
| cerium | 0.005 - 0.02 |
| nickel | the balance. |

4 Claims, No Drawings

NICKEL-BASED ALLOY

The present invention relates to heat-resistant weldable alloys and more particularly to nickel-based alloys.

The present invention can be used most effectively for preparing sheets employed in primary welded structures. The present invention can also be used for manufacturing rods and washers.

Welding simplifies the technology of making structures and decreases their weight. Therefore, modern production calls for heat-resistant weldable alloys.

Known in the art is nickel-based alloy including carbon, chromium, cobalt, titanium, aluminum, tungsten, boron in the following weight %:

| | |
|---|---|
| carbon | 0.09 |
| chromium | 19.0 |
| cobalt | 11.0 |
| titanium | 3.1 |
| aluminum | 1.5 |
| molybdenum | 10.0 |
| boron | 0.01 |
| nickel | the balance. |

Sheets are made from the above-cited alloy which are used in welded structures.

However, this known alloy possesses low heat-resistance ($\sigma_{100}^{815^\circ C} = 31.5$ kg/mm$^2$, $\sigma_{100}^{980^\circ C} = 7$ kg/mm$^2$).

Also known in the art is a nickel-based alloy including carbon, chromium, cobalt, titanium, aluminum, tungsten, molybdenum, boron in the following weight %:

| | |
|---|---|
| carbon | 0.1 |
| chromium | 14.0 |
| cobalt | 15.0 |
| titanium | 2.5 |
| aluminum | 3.8 |
| tungsten | 3.0 |
| molybdenum | 6.0 |
| boron | 0.015 |
| nickel | the balance. |

This alloy has high heat-resistance of the order of $\sigma_{100}^{980^\circ C} = 7.7$ kg/mm$^2$.

Yet it is undesirable to use the above-cited alloy in welded structures, since thermal treatment is needed before welding thereof, which involves complicated process conditions and stepwise cooling. Besides, certain sheet welded structures require stamping and repeated thermal treatment, which precludes the use of said alloy.

Likewise known in the art is a nickel-based alloy including carbon, chromium, cobalt, titanium, aluminum, tungsten, molybdenum, boron, manganese, yttrium in the following weight %:

| | |
|---|---|
| carbon | 0.05 - 0.12 |
| chromium | 14.0 - 18.0 |
| cobalt | 13.0 - 18.0 |
| titanium | 4.5 - 6.5 |
| aluminum | 2.0 - 3.0 |
| tungsten | 1.5 - 2.0 |
| molybdenum | 2.5 - 3.5 |
| boron | 0.008 - 0.029 |
| manganese | 0.00 - 0.5 |
| yttrium | 0.00 - 0.1 |
| nickel | the balance. |

The above nickel-based alloy is used for manufacturing disks and blades for compressors and possesses high heat-resistance ($\sigma_{100}^{730^\circ C} = 63$ kg/mm$^2$, $\sigma_{100}^{870^\circ C} = 31.5$ kg/mm$^2$) combined with phase stability of the alloy structure.

However, it is impossible to form sheets and weld this alloy due to its poor deformability.

The principal object of the invention is to provide a nickel-based alloy containing such components and in such a ratio which will provide higher deformability and weldability of the alloy its ability to be thermally treated after welding without cracking as compared to the known similar nickel-based alloys.

Another important object of the invention is to provide a nickel-based alloy similar to the above with such components and in such a ratio which will ensure higher heat resistance and strength as compared to the known similar nickel-based alloys.

A further object of the invention is to provide a nickel-based alloy similar to the above with such components and in such a ratio which will ensure higher stability of its structure as compared to known nickel-based alloys.

Said and other objects are accomplished in a nickel-based alloy containing carbon, chromium, cobalt, titanium, aluminum, tungsten, molybdenum, yttrium, boron in the following weight %:

| | |
|---|---|
| carbon | 0.05 - 0.10 |
| chromium | 15.0 - 18.0 |
| cobalt | 10.0 - 17.0 |
| titanium | 1.8 - 2.5 |
| aluminum | 2.8 - 3.5 |
| tungsten | 2.5 - 5.0 |
| molybdenum | 6.0 - 7.5 |
| yttrium | up to 0.2 |
| boron | 0.005 - 0.02 |

which, according to the invention, also contains magnesium in amounts of 0.005 - 0.05 wt %, cerium in amounts of 0.005 - 0.02 wt %, the balance being nickel.

It is known that carbon, forming secondary carbides, strengthens grain boundaries of the alloy.

A decrease in carbon content below the lower limit weakens grain boundaries of the alloy and causes cracking during thermal treatment after welding.

An increase in carbon content above the upper limit causes size reduction of grains which lowers the heat-resistance of the alloy. Grain size and heat-resistance can be enhanced by hardening at a temperature above 1200° C. However, this leads to partial melting along the grain boundaries and, consequently, to weakening of the alloy.

It is commonly known that chromium increases heat-resistance of nickel-based alloys and improves their weldability.

Chromium content less than 15 wt % causes cracking of the alloy during thermal treatment after welding since a decrease in chromium content increases that of the strengthening $\gamma'$-phase.

An increase in chromium content above 18% favors the formation of the embrittlement $\sigma$-phase, i.e. instability of the alloy structure, thus decreasing its heat-resistance and causing cracking in the process of welding and thermal treatment after welding.

It is universally known that cobalt enhances heat-resistance of alloys and their deformability in hot state.

A decrease in cobalt content less than 10 wt % impairs heat-resistance of the alloy and deteriorates its deformability in hot state.

A rise in cobalt content above 17 wt % favors the formation of the embrittlement $\sigma$-phase, i.e. instability of the alloy structure.

It is a well known fact that titanium and aluminum increase heat-resistance of dispersion-hardening nickel-based alloys due to the formation of strengthening $\gamma'$-phase based on $Ni_3(AlTi)$.

The reduction in titanium and aluminum content below the lower limits impairs heat-resistance of the nickel-based alloy whereas its increase above the upper limits deteriorates its deformability and leads to the formation of the embrittlement $\sigma$-phase, i.e. to instability of the structure of this alloy.

It is commonly known that tungsten increases heat-resistance of nickel-based alloys.

A decrease in tungsten content in the alloy below the lower limit deteriorates heat-resistance, whereas an increase above the upper limit favors cracking of the alloy during thermal treatment after welding.

It is commonly known that molybdenum increases heat-resistance of nickel-based alloys.

A decrease in molybdenum content below 6 wt % favors cracking of the alloy during thermal treatment after welding.

A molybdenum content above 7.5 wt % leads to the formation of $\mu$-phase, i.e. to instability of the structure of the alloy.

Yttrium in said alloy enhances heat-resistance thereof. Yttrium content above 0.2 wt % deteriorates deformability of the alloy.

It is commonly known that boron increases heat-resistance of the alloy due to the formation of borides which strengthen the grain boundaries.

Boron content less than 0.005 wt % decreases heat-resistance of the alloy, whereas its rise above 0.02 wt % deteriorates its deformability.

Magnesium, according to the invention, is introduced into the alloy within said limits to improve deformability and weldability of the alloy and decrease its ability to cracking during thermal treatment after welding.

Cerium, according to the invention, is introduced into the alloy to enhance its heat-resistance and improve deformability and weldability thereof.

Cerium content below 0.005 wt % impairs heat-resistance, deformability, and weldability of the alloy. The content above 0.02 wt % deteriorates the alloy deformability.

It is expedient that the nickel-based alloy contain the following components in weight percent;

| | |
|---|---|
| carbon | 0.05 – 0.07 |
| chromium | 16.5 – 17.0 |
| cobalt | 10.0 – 12.0 |
| titanium | 1.8 – 2.2 |
| aluminum | 2.8 – 3.2 |
| tungsten | 2.8 – 3.5 |
| molybdenum | 6.0 – 6.5 |
| yttrium | up to 0.02 |
| boron | 0.005 – 0.015 |
| magnesium | 0.005 – 0.015 |
| cerium | 0.005 – 0.015 |
| nickel | the balance. |

The inclusion of the above-cited components within said limits provides the best combination of heat-resistance, deformability, and weldability of the nickel-based alloy, which makes it possible to prepare sheets from this alloy, weld them, and perform thermal treatment after welding without cracking.

It is desirable that the ratio of titanium to aluminum be 2:3.This improves the ability of welded joints made from said alloy to thermal treatment after welding without crack formation.

The present invention provides a nickel-based alloy which possesses high deformability, weldability, heat-resistance, strength, and structure stability.

The proposed nickel-based alloy can be obtained by any method known to those skilled in the art.

EXAMPLE 1

The main charge components, namely, nickel, chromium, cobalt, titanium, aluminum, tungsten, and molybdenum are loaded into a furnace.

After a melt of these elements has been obtained, carbon, yttrium, boron, magnesium, and cerium are added.

Then the melt is stirred and poured into moulds for preparing ingots. The nickel-based alloy obtained contains, in weight %:

| | |
|---|---|
| carbon | 0.05 |
| chromium | 17.0 |
| cobalt | 10.1 |
| titanium | 1.9 |
| aluminum | 3.2 |
| tungsten | 2.8 |
| molybdenum | 6.5 |
| yttrium | 0.001 |
| boron | 0.006 |
| magnesium | 0.01 |
| cerium | 0.013 |
| nickel | the balance. |

The proposed alloy can most effectively be employed for preparing sheets 1 mm thick for use in welded structures.

The tests have shown that a sheet made from the proposed alloy, after strengthening thermal treatment, has the following characteristics shown in Table 1

Table 1

| Mechanical properties | | | | Heat-resistance | |
|---|---|---|---|---|---|
| Temperature ° C | ultimate strength $\Sigma_6$, kg/mm$^2$ | yield limit $\Sigma_{92}$, kg/mm$^2$ | relative elongation $\Delta$, % | stress $\Sigma$, kg/mm$^2$ | time before destruction $\tau$, hours |
| 20 | 128–130 | 87–88 | 26–28 | — | — |
| 700 | 96–98 | 76–78 | 12–15 | 65 | 143–152 |
| 800 | 85–87 | 73–75 | 10–12 | 38 | 162–175 |
| 900 | 59–63 | 56–58 | 10–12 | 18 | 145–159 |
| 1000 | 28–32 | 25–27 | 16–20 | 6 | 130–145 |

EXAMPLE 2

The main charge components, namely, nickel, chromium, cobalt, titanium, aluminum, tungsten, and molybdenum are loaded into a furnace.

After a melt of these elements has been obtained, carbon, yttrium, boron, magnesium, and cerium are added.

Then the melt is stirred and poures into moulds for preparing ingots.

The nickel-based alloy obtained contains, in weight %:

| | |
|---|---|
| carbon | 0.08 |
| chromium | 15.0 |
| cobalt | 16.5 |
| titanium | 1.9 |
| aluminum | 2.8 |
| tungsten | 3.1 |
| molybdenum | 6.0 |
| yttrium | 0.005 |
| boron | 0.018 |

-continued

| | |
|---|---|
| magnesium | 0.008 |
| cerium | 0.007 |
| nickel | the balance. |

The proposed alloy can most effectively be employed for preparing sheets 2.5 mm thick for use in welded structures.

Tests have shown that a sheet made from the proposed alloy, after strengthening thermal treatment, has the following characteristics shown in Table 2.

Table 2

| Mechanical properties | | | | Heat-resistance | |
|---|---|---|---|---|---|
| Temperature ° C | ultimate strength $\Sigma_6$, kg/mm² | yield limit $\Sigma_{92}$, kg/mm² | relative elongation Δ ,% | stress Σ , kg/mm² | time before destruction τ , hours |
| 20 | 125–128 | 85–87 | 25–28 | — | — |
| 700 | 96–98 | 76–77 | 12–14 | 65 | 145–160 |
| 800 | 83–86 | 70–73 | 12–15 | 38 | 158–165 |
| 900 | 58–63 | 56–58 | 10–14 | 18 | 160–172 |
| 1000 | 28–32 | 25–27 | 17–21 | 6 | 155–170 |

EXAMPLE 3

The main charge components, namely, nickel, chromium, cobalt, titanium, aluminum, tungsten, and molybdenum are loaded into a furnace.

After a melt of these elements has been obtained, carbon, yttrium, boron, magnesium, and cerium are added.

Then the melt is stirred and poured into moulds for preparing ingots.

The nickel-based alloy obtained contains, in weight %:

| | |
|---|---|
| carbon | 0.06 |
| chromium | 17.6 |
| cobalt | 10.1 |
| titanium | 2.2 |
| aluminum | 3.1 |
| tungsten | 4.5 |
| molybdenum | 6.0 |
| yttrium | 0.1 |
| boron | 0.008 |
| magnesium | 0.03 |
| cerium | 0.015 |
| nickel | the balance. |

The proposed alloy can most effectively be employed for preparing rods 30mm in diameter for use in welded structures.

Tests have shown that a rod made from the proposed alloy, after strengthening thermal treatment, has the following characteristics given in Table 3.

Table 3

| Mechanical properties | | | | Heat-resistance | |
|---|---|---|---|---|---|
| Temperature ° C | ultimate strength $\Sigma_6$, kg/mm² | yield limit $\Sigma_{92}$, kg/mm² | relative elongation Δ ,% | stress Σ , kg/mm² | time before destruction τ ,hours |
| 20 | 120–125 | 84–85 | 22–25 | — | — |
| 700 | 89–95 | 75–77 | 10–12 | 73 | 210–235 |
| 800 | 82–86 | 70–72 | 12–13 | 43 | 190–215 |
| 900 | 55–60 | 52–53 | 12–13 | 21 | 140–152 |
| 1000 | 25–27 | 23–24 | 16–18 | 7 | 156–173 |

EXAMPLE 4

The main charge components, nickel, chromium, cobalt, titanium, aluminum, tungsten, and molybdenum are loaded into a furnace.

After a melt of these elements has been obtained, carbon, yttrium, boron, magnesium, and cerium are added.

Then the melt is stirred and poured into moulds for preparing ingots. The nickel-based alloy obtained contains in weight %:

| | |
|---|---|
| carbon | 0.06 |
| chromium | 15.0 |
| cobalt | 12.1 |
| titanium | 2.2 |
| alumimum | 3.2 |
| tungsten | 2.8 |
| molybdenum | 7.3 |
| yttrium | 0.001 |
| boron | 0.006 |
| magnesium | 0.007 |
| cerium | 0.013 |
| nickel | the balance. |

The proposed alloy can most effectively be employed for preparing washers for use in welded structures.

Tests have shown that a washer made from the proposed alloy, after strengthening thermal treatment, has the following characteristics given in Table 4.

Table 4

| Mechanical properties | | | | Heat-resistance | |
|---|---|---|---|---|---|
| Temperature ° C | ultimate strength $\Sigma_6$, kg/mm² | yield limit $\Sigma_{92}$, kg/mm² | relative elongation Δ ,% | stress Σ , kg/mm² | time before destruction τ ,hours |
| 20 | 120–123 | 85–88 | 25–28 | — | — |
| 700 | 91–93 | 75–78 | 12–14 | 70 | 190–205 |
| 800 | 85–87 | 71–73 | 10–12 | 40 | 195–215 |
| 900 | 60–63 | 56–58 | 10–12 | 20 | 150–165 |
| 1000 | 25–27 | 23–25 | 10–16 | 7 | 170–185 |

Testing for crack formation of the welded joints made from the proposed alloy was carried out on a complex-stressed 12 mm-thick specimen with firth seam preparation, the stresses therein being close to those observed in actual welded structures. Welding was performed by the argon-arc method using a tungsten electrode with a filler.

Tests have shown that, when the residual stresses were removed after welding, the specimens did not crack during thermal treatment.

The proposed nickel-based alloy, according to the invention, can possesses the following properties given in Table 5.

Table 5

| | Cold-rolled sheet 1–2.5 mm thick | | Rod 30–40 mm in dia | |
|---|---|---|---|---|
| Temperature ° C | Stress, kg/mm² | Time before destruction, hours | Stress, kg/mm² | Time before destruction, hours |
| 700 | 65–70 | more than 100 | 73–75 | more than 100 |
| 800 | 38–40 | more than 100 | 42–44 | more than 100 |
| 900 | 17–18 | more than 100 | 20–22 | more than 100 |
| 1000 | 5.5–6.0 | more than 100 | 6.5–8.0 | more than 100 |

What is claimed is:

1. A nickel-based alloy consisting of carbon, chromium, cobalt, titanium, aluminum, tungsten, molybdenum, yttrium, boron, magnesium, and cerium, said components being present in the following weight %:

| | |
|---|---|
| carbon | 0.05 – 0.10 |
| chromium | 15.0 – 18.0 |
| cobalt | 10.0 – 17.0 |
| titanium | 1.8 – 2.5 |
| aluminum | 2.8 – 3.5 |
| tungsten | 2.5 – 5.0 |

-continued

| | |
|---|---|
| molybdenum | 6.0 - 7.5 |
| yttrium | up to 0.2 |
| boron | 0.005 - 0.02 |
| magnesium | 0.005 - 0.05 |
| cerium | 0.005 - 0.02 |
| nickel | the balance. |

2. An alloy as claimed in claim 1, which contains said components in the following weight %:

| | |
|---|---|
| carbon | 0.05 - 0.07 |
| chromium | 16.5 - 17.0 |

-continued

| | |
|---|---|
| cobalt | 10.0 - 12.0 |
| titanium | 1.8 - 2.2 |
| aluminum | 2.8 - 3.2 |
| tungsten | 2.8 - 3.5 |
| molybdenum | 6.0 - 6.5 |
| yttrium | up to 0.02 |
| boron | 0.005 - 0.015 |
| magnesium | 0.005 - 0.015 |
| cerium | 0.005 - 0.015 |
| nickel | the balance |

3. An alloy as claimed in claim 1, in which the ratio of titanium to aluminum is 2:3.

4. An alloy as claimed in claim 2, in which the ratio of titanium to aluminum is 2:3.

* * * * *